US005358101A

United States Patent [19]

Lombardi

[11] Patent Number: 5,358,101

[45] Date of Patent: Oct. 25, 1994

[54] DISPLAY CASE AND BOTTLE ASSEMBLY

[76] Inventor: Carl M. Lombardi, 424 W. Neck Rd., Lloyd Harbour, N.Y. 11743

[21] Appl. No.: 205,810

[22] Filed: Mar. 4, 1994

[51] Int. Cl.[5] ..... B65D 85/30

[52] U.S. Cl. ..... 206/45.16; 206/45.19; 206/581; 206/485; 206/523

[58] Field of Search ..... 206/45.31, 45.33, 45.34, 206/45.14, 45.16, 45.19, 485, 486, 488, 489, 523, 588, 589, 581

[56] References Cited

U.S. PATENT DOCUMENTS

| | | | |
|---|---|---|---|
| 3,192,680 | 7/1965 | Mantell et al. | 206/485 X |
| 3,424,825 | 2/1966 | Marchand | 206/45.19 X |
| 4,522,303 | 6/1985 | Starr | 206/523 X |
| 4,826,003 | 5/1989 | Levy | 206/523 X |
| 5,299,700 | 4/1994 | Beniacar | 206/485 X |

*Primary Examiner*—Jacob K. Ackun, Jr.

*Attorney, Agent, or Firm*—Michael Ebert

[57] ABSTRACT

A display case assembly adapted to store at least one bottle or other container and to protectively house this bottle within a display case formed by a tray and a cover therefor. The bottle is provided with a removable cap whose top end has a distinct geometric form and a base whose bottom end has a distinct geometric form. The top end of the bottle is nested within a similarly shaped socket formed on an upper retainer plate pressed against the upper wall of the tray. The bottom end of the bottle is nested within similarly-shaped socket formed in a lower retainer plate that rests on and compresses a resilient foam-plastic pad seated on the lower wall of the tray. The bottle is subjected to pressure by the compressed pad which holds it in place and acts as a shock mounting. The case may be made of transparent material so that the bottle housed therein is exhibited.

9 Claims, 4 Drawing Sheets

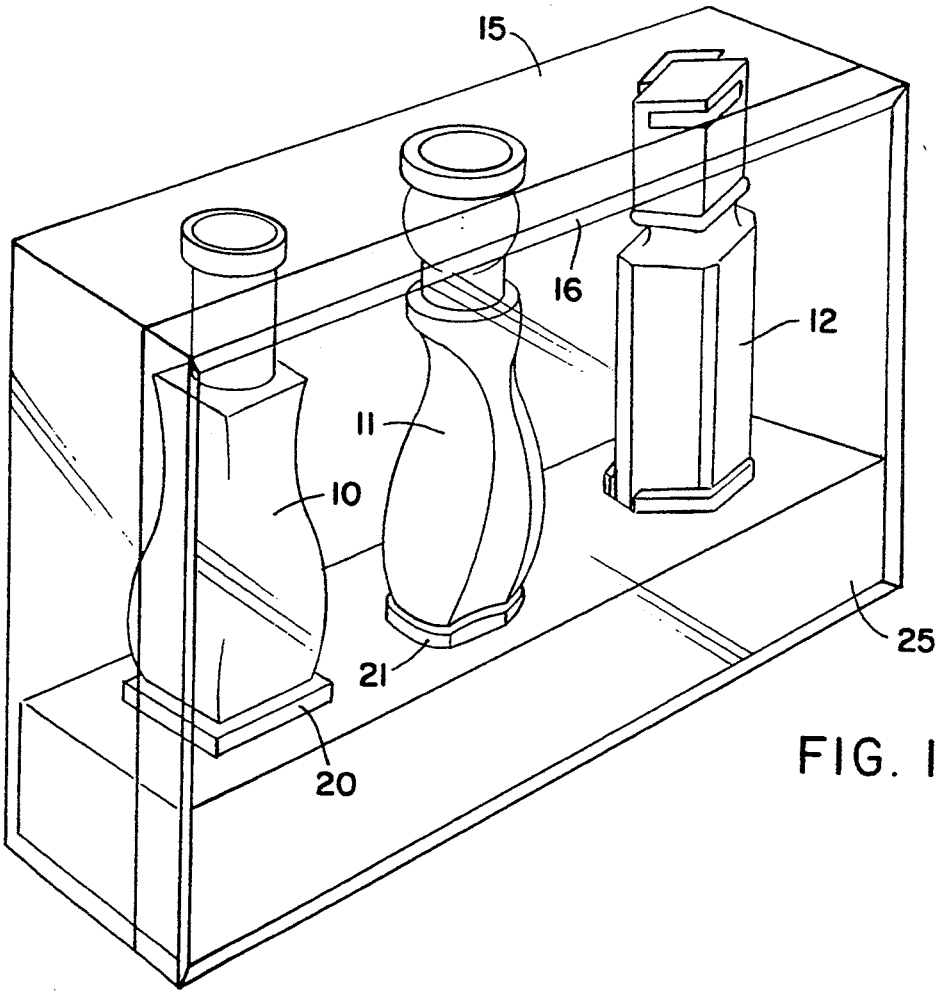
FIG. 1
FIG. 4
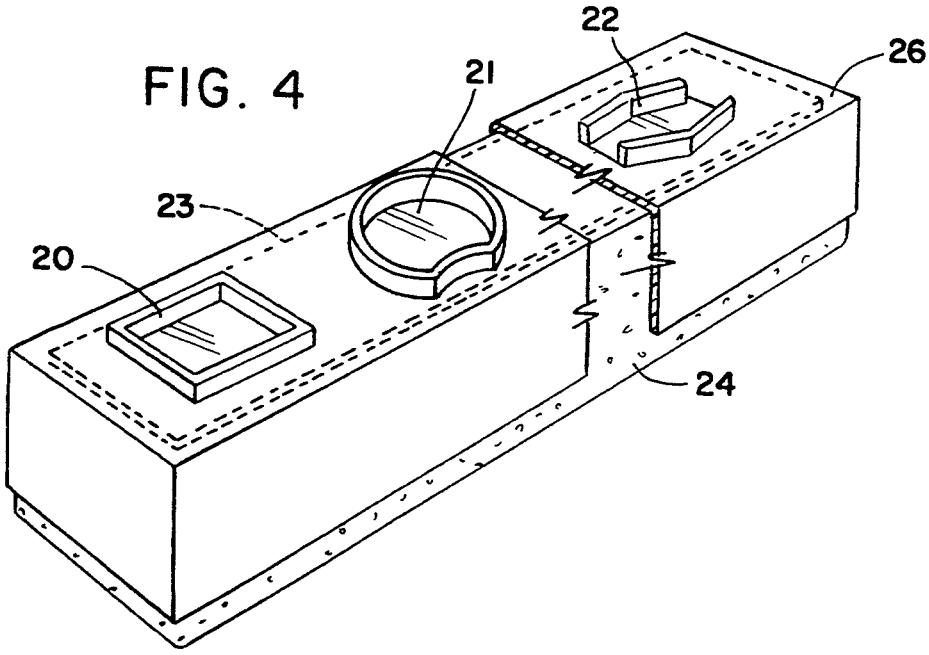

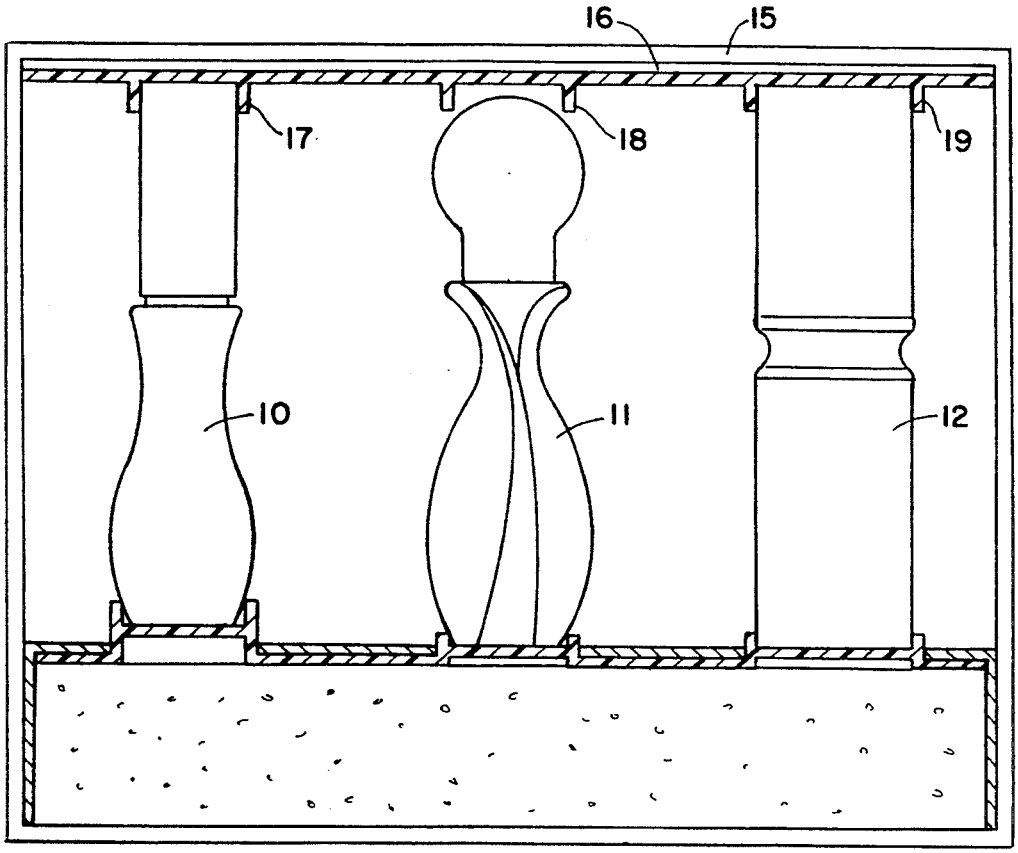
FIG. 5
FIG. 6
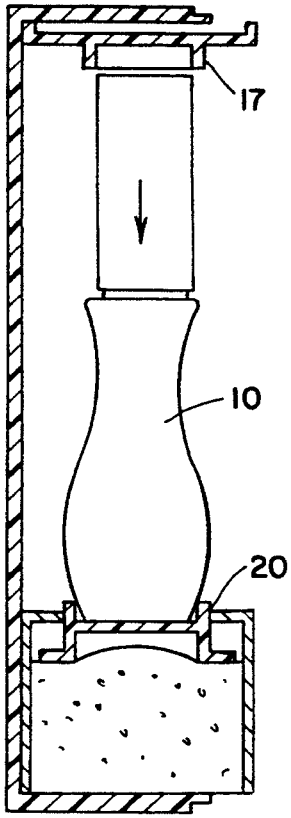
FIG. 7
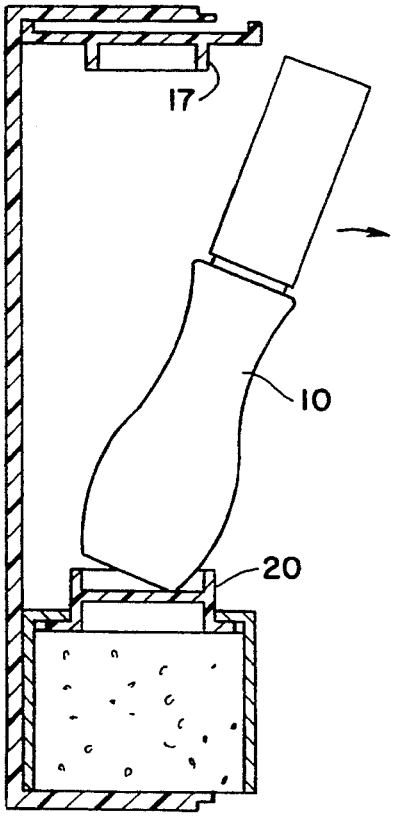

DISPLAY CASE AND BOTTLE ASSEMBLY

BACKGROUND OF THE INVENTION

1. Field of Invention

This invention relates generally to display cases for bottles and similar items, and more particularly to a display case assembly which exhibits a row of at least three fragrance bottles and acts to shock mount and protectively house these bottles.

2. Status of Prior Art

Liquid fragrances such as perfumes, scents and toilet waters are contained in shaped bottles provided with removable caps. These fragrances which are costly, usually come in bottles formed of crystal glass of high clarity, molded or cut into an attractive decorative form that identifies the fragrance contained therein. Indeed, the shape of a perfume bottle is often treated as its trade dress, for from the bottle appearance, one is informed as to its contents.

Thus bottles for fragrances bearing the well-known CHANEL mark are quite different in shape from those bearing the REVLON mark, the more expensive the perfume, the more elegant its container. The quality and shape of a fragrance bottle and the visual impression it makes are indispensable elements in the mystique associated with fragrances.

When a single fragrance bottle is packaged within a small box, it is then a simple matter to protect the bottle against shock forces, use being made of corrugated board padding or other shock-mounting expedients for this purpose. However, from a merchandising standpoint, particularly when a prospective purchaser is being offered a set of different fragrances, each possibly contained in a distinctly shaped bottle, it is then the practice to package the set in a transparent plastic case so that all of the bottles are exhibited.

In a display case arrangment of this type, it is not possible to surround each bottle in the set with padding or other protective material, for expedient would conceal the bottle. And while for purposes of transportation and handling, a display case containing a set of fragrance bottles could be packaged in a carton having foam-plastic padding, such padding does not act to prevent the bottles within the display case from becoming loose and rattling against each other.

SUMMARY OF INVENTION

In view of the foregoing, the main object of this invention is to provide a display case assembly adapted to protectively house and shock mount one or more bottles or similar items within a display case so that the bottles, when subjected to shock forces, will remain at their assigned positions.

More particularly, an object of this invention is to provide a display case assembly of the above type in which the bottles housed therein differ from each other in shape, yet each bottle is securely held in place and is shock-mounted to resist impact forces.

Also an object of this invention is to provide a display case assembly of the above type in which the fragrance bottles may be installed without difficulty within the transparent case by a simple procedure, whereby the cost of assembly is low.

A significant feature of the invention is that the assembly is tailored to the particular top end and bottom end geometric shapes of the fragrance bottle housed in the transparent case, and the same assembly may be arranged to house bottles regardless of their bottom end and top end shapes simply by providing retainer plates to accommodate these shapes.

Briefly stated, in a preferred embodiment of the invention these objects are attained by a display case assembly adapted to exhibit at least three fragrance bottles and to protectively house these bottles within a transparent display case formed by a rectangular tray and a cover therefor functioning as a window. Each bottle is provided with a removable cap whose top end has a distinct geometric form and a base whose bottom end has a distinct geometric form, all differing from each other, the bottles being of substantially the same height.

The top ends of the bottles are nested within similarly shaped sockets formed on an upper retainer plate pressed against the upper wall of the tray. The bottom ends of the bottles are nested within similarly-shaped sockets formed in a lower retainer plate that rests on and compresses a resilient foam-plastic pad seated on the lower wall of the tray. The bottles are subjected to pressure by the compressed pad which holds them in place and acts as a shock mounting.

BRIEF DESCRIPTION OF DRAWINGS

For a better understanding of the invention, as well as further features thereof, reference is made to the following detailed description to be read in conjunction with the accompanying drawings wherein:

FIG. 1 illustrates, in perspective, a display case assembly for a set of three bottles in accordance with the invention;

FIG. 4 shows the sub-assembly formed by the platform, the lower retainer plate and the resilient foam plastic pad;

FIG. 5 is a longitudinal section taken through the assembly shown in FIG. 1;

FIG. 6 shows one of the bottles housed within the assembly;

FIG. 7 shows the bottle as it is being removed from the assembly; and

DESCRIPTION OF INVENTION

Figure 2:
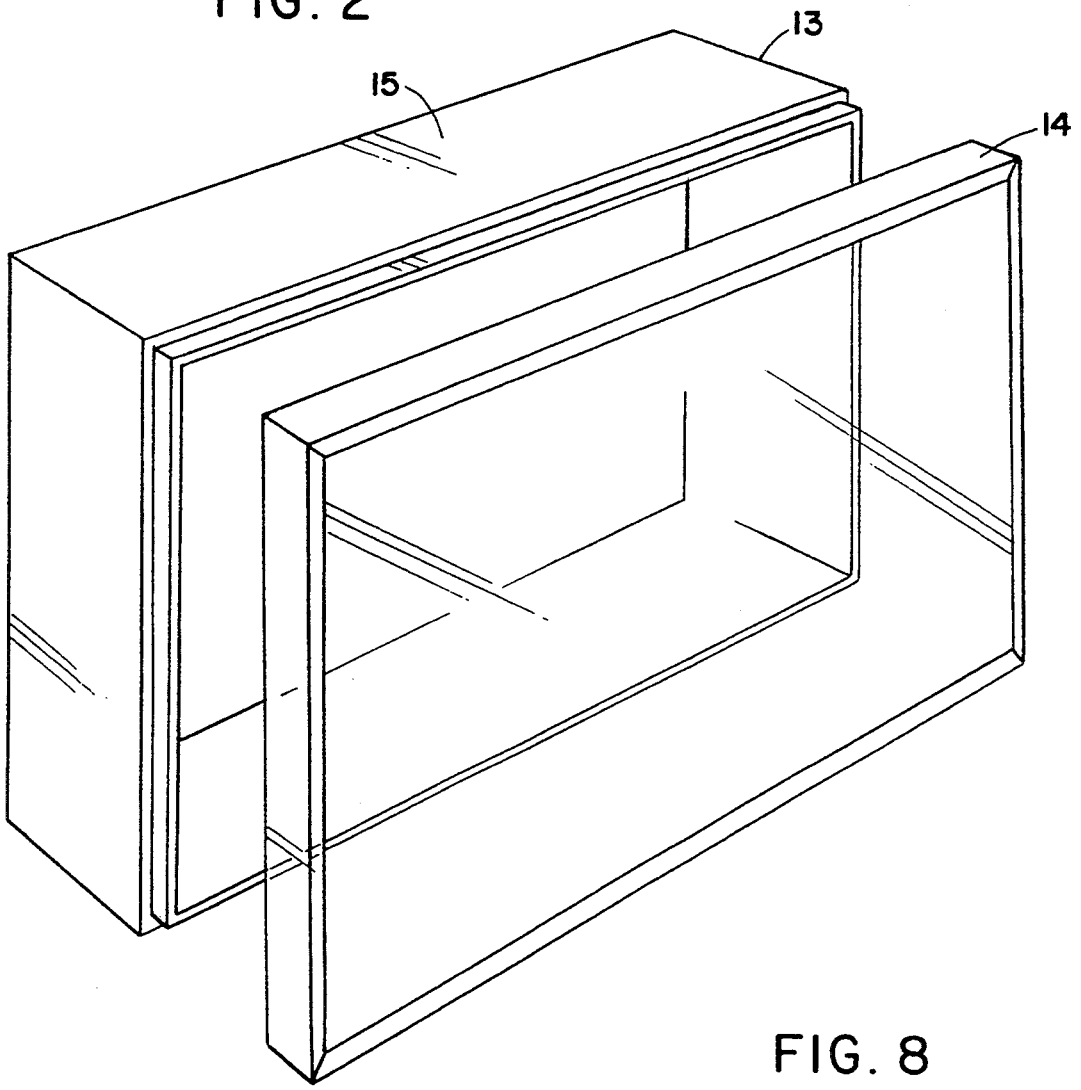
FIG. 2 is a separate view of the two parts of the display case.
Figure 3:
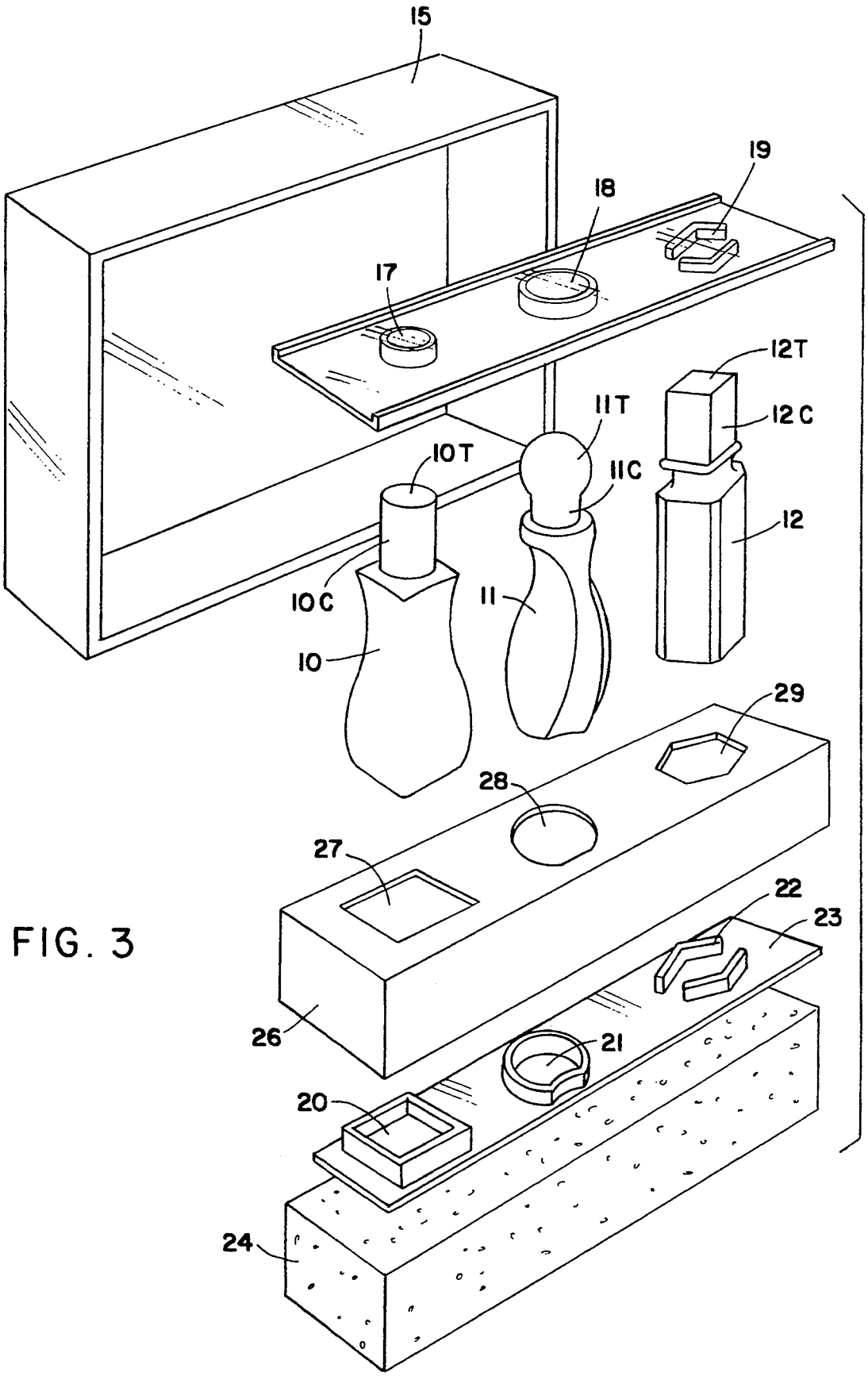
FIG. 3 is an exploded view of the assembly.

Referring now to FIGS. 1 to 3, there is shown in these figures a preferred embodiment of a display case assembly in accordance with the invention adapted to house and exhibit a row of three fragrance bottles 10, 11 and 12 having different shapes. It is to be understood that the assembly made be designed to house a greater or lesser number of bottles or containers, and that the bottles may be used to contain liquids or substances other than fragrances.

Bottles 10, 11 and 12 are provided with removable caps 10C, 11C and 12C, respectively, whose top ends each have a distinct geometric form. The base of each bottle is provided with a bottom end having a distinct geometric form.

Figure 8:
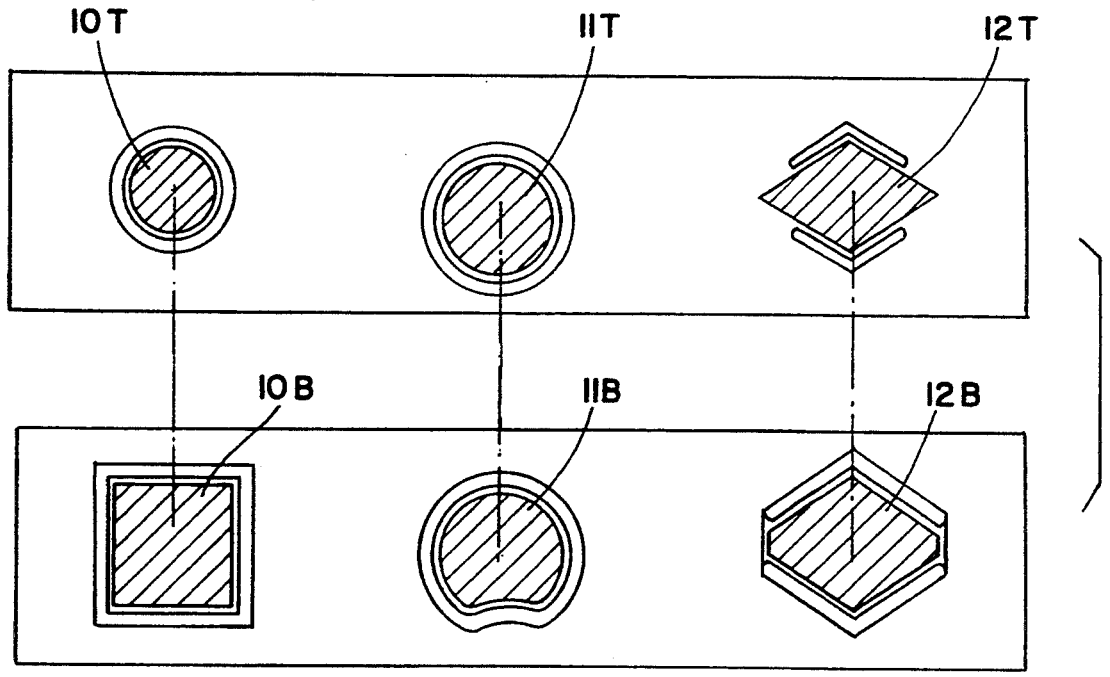
FIG. 8 illustrates the relationship existing between the bottom ends of the three bottles and the related sockets on the lower retainer plate, and between the top ends of the bottles and the sockets on the upper retainer plate.

As shown in FIG. 8 the top end 10T of cap 10C of bottle 10 is circular, while the bottom end 10B of this bottle is square shaped. The top end 11T of cap 11C of this bottle is dome shape, while the bottom end 11B of bottle 11 has the form of a circle having a flat therein. The top end 12T of cap 12C of bottle 12 is diamond shaped, as is the bottom end 12B of this bottle. Though bottles 10, 11 and 12 have distinctly different shapes, they are all of substantially the same height.

The display case for these bottles as shown separately in FIG. 2 is formed of transparent synthetic plastic material, such as PVC, polypropylene, polystyrene or SAN, and is composed of a rectangular tray 13 having a rectangular flange surrounding its opening, and a removable cover 14 therefor, which fits over the flange and functions as the window of the display assembly. However, in practice the case may be formed of an opaque colorless plastic so that the bottles housed therein are concealed.

Pressed against the upper wall 15 of tray 13 by the bottles is a transparent plastic retainer plate 16 whose rectangular dimensions match those of this wall. Formed in the underside of plate 16 and projecting therefrom are three shaped sockets 17, 18 and 19 to receive the respective top ends of the bottle caps. Thus socket 17 is cylindrical to receive the circular top end 10T of the bottle cap 10C. Socket 18 is a cylinder of larger diameter to nest the dome-shaped top end 11T of bottle 11. Diamond shaped socket 19 is formed of complementary angle pieces to nest the diamond-shaped top end 12T of bottle 12.

The bottom ends 10B, 11B and 12B of bottles 10, 11 and 12 are nested respectively within socket 20, 21 and 22 formed in the upper side of a transparent plastic lower retainer plate 23 and projecting therefrom.

As best seen in FIG. 1 and 8, socket 20 on lower retainer plate 23 is a square shaped receptacle to receive the square shaped bottom end 10B of bottle 10. Socket 21 is a cylindrical receptacle having a flat thereon to accommodate the like-shaped bottom end **11*b* of bottle 11. And socket 22 is a diamond-shaped receptacle to nest the like shaped bottom end 12B of bottle 12**.

The lower retainer plate 23 rests on and compresses a flexible foam-plastic pad 24 of polyurethane or similar resilient material which rests on the bottom wall 25 of tray 13. The height of pad 24 relative to that of the bottles is such that in order to fit the bottles between the upper and lower retainer plates, the foam pad must be compressed to allow the bottles to be received in the top and bottom sockets.

As a consequence, when the bottles are mounted within the tray, they are subjected to pressure by the compressed foam plastic pad which seeks to recover its original dimensions. The pad, therefore, holds the bottles in place and also acts as a shock absorber for the bottles.

Pad 24 is concealed within a box-like carboard platform 26 having an open bottom and a top wall provided with cutouts which are shaped to permit sockets 20, 21 and 22 of the lower retainer plate 23 to project therethrough, as shown in FIGS. 1 and 4.

It is a simple matter to install the bottles in the display case. The first step is to place the sub-assembly of the platform 26, plate 23 and pad 24 within the tray to rest on the lower wall 25. Then while holding the upper plate 16 against the upper wall 15 of the tray, one inserts one bottle at a time, the bottom end of each bottle being placed in its lower retainer socket and then being pushed down to depress the pad so that its top end can be nested with its socket in the upper retainer plate.

When the user of the display case wishes to remove a bottle therefrom, all that need be done, as shown in FIGS. 6 and 7, is to remove the cover from the tray, and push down on the bottle to be removed, so that its top end can be disengaged from its upper retainer plate socket.

While there has been shown a preferred embodiment of the invention, it is to be understood that many changes may be made thereon without departing from the spirit of the invention. Thus the bottles may vary somewhat in height in accordance with the manufacturer's stated tolerances. But these differences in height will be accommodated by the foam plastic pad. And the tray need not be in a rectangular form, but may be in any desired form. And it is not necessary that the bottles housed in the case have different shapes, for they may all have the same shape, but whatever their shapes, the sockets in the retainer plates must be shaped to nest the top and bottom ends of the bottles.

I claim:

1. A display case assembly adapted to protectively house and exhibit a plurality of bottles of substantially the same height, each bottle being provided with a removable cap whose top end has a distinct geometric shape and a base whose bottom end has a distinct geometric shape, all differing from each other; said assembly comprising:

A. said bottles in said display case;

B. a rectangular tray having an upper and lower wall and a removable cover therefor, the tray and cover being formed of transparent plastic material;

C. an upper retainer plate lying against the upper wall of the tray and provided with a plurality of projecting sockets which are shaped to nest the respective top ends of the bottles;

D. a compressible pad formed of resilient material seated on the lower wall of the tray; and E. a lower retainer plate resting on the pad and compressing same, said lower plate being provided with a plurality of projecting sockets which are shaped to nest the respective bottom ends of the bottles whereby the compressed pad which seeks to recover its uncompressed form acts to hold the bottles in place within the tray and to absorb shock forces to which the assembly is subjected.

2. An assembly as set forth in claim 1, in which the bottles are fragrance bottles having different shapes.

3. An assembly as set forth in claim 1, in which said upper and lower retainer plates are formed of transparent synthetic plastic material.

4. An assembly as set forth in claim 1, in which the pad is formed of flexible foam-plastic material.

5. An assembly as set forth in claim 1, in which said pad is concealed within a box-like platform housing an open bottom and a top wall having cut-outs therein through which project the sockets formed in the lower retainer plate resting on the pad.

6. An assembly as set froth in claim 1, in which the top end of one bottle has a circular shape and the bottom end of the bottle has a square shape.

7. An assembly as set forth in claim 1, in which the top end of another bottle has a diamond-like shape and the bottom end of the bottle has a diamond-like shape.

8. A display case assembly adapted to store and protectively house at least one container provided with a removable cap whose top end has a distinct geometric shape and a base whose bottom end has a distinct geometric shape, said assembly comprising:

A. said at least one container in said display case;

B. a tray having an upper and a lower wall and a removable cover therefor;

C. an upper retainer plate lying against the upper wall of the tray and provided with at least one projecting socket which is shaped to nest the top end of the at least one container;

D. a compressible pad formed of resilient material seated on the lower wall of the tray; and E. a lower retainer plate resting on the pad and compressing same, said lower plate being provided with a single or a projecting socket which is shaped to nest the bottom end of the at least one container whereby the compressed pad which seeks to recover its uncompressed form, acts to hold the at least one container in place within the tray and to absorb shock forces to which the assembly is subjected.

9. A display case as set forth in claim 8, in which the cover of the tray is transparent whereby the at least one container exhibited.

* * * * *